US008671805B2

(12) United States Patent
Henderson et al.

(10) Patent No.: US 8,671,805 B2
(45) Date of Patent: Mar. 18, 2014

(54) CEILING SUPPORT INSTALLATION SYSTEM

(75) Inventors: David Henderson, Toronto (CA); Michael Feron, Woodstock (CA); So Nguyen Lam, Markham (CA)

(73) Assignee: Illinois Tool Works, Inc., Glenview, IL (US)

( * ) Notice: Subject to any disclaimer, the term of this patent is extended or adjusted under 35 U.S.C. 154(b) by 6 days.

(21) Appl. No.: 13/099,433

(22) Filed: May 3, 2011

(65) Prior Publication Data

US 2012/0279360 A1 Nov. 8, 2012

(51) Int. Cl.
*B25B 13/00* (2006.01)

(52) U.S. Cl.
USPC ..... 81/124.2; 29/813; 7/138; 81/177.1

(58) Field of Classification Search
USPC ..... 81/119–125.1, 53.1, 177.1, 177.2; 7/138, 108, 117, 170
See application file for complete search history.

(56) References Cited

U.S. PATENT DOCUMENTS 882,937 A * 3/1908 Pegley ..... 81/124.2
4,689,881 A * 9/1987 Fall ..... 29/813
4,724,731 A * 2/1988 Onofrio ..... 81/119
5,012,624 A * 5/1991 Dahlgren ..... 52/506.06
5,154,104 A * 10/1992 O ..... 81/177.2
5,363,525 A * 11/1994 Andreasen ..... 7/138
5,439,338 A * 8/1995 Rosenberg ..... 411/400
5,507,209 A * 4/1996 Allen et al. ..... 81/124.2
5,809,850 A * 9/1998 Tickner ..... 81/53.11
5,809,851 A * 9/1998 Thompson ..... 81/124.2
5,887,631 A * 3/1999 Eaton ..... 140/118
6,095,016 A * 8/2000 Lam ..... 81/121.1
6,786,116 B2 * 9/2004 Dockery ..... 81/177.1
8,051,745 B2 * 11/2011 Petrak ..... 81/57.38
8,083,276 B2 * 12/2011 Schopp ..... 294/24
2003/0033910 A1 * 2/2003 Goacher, Sr. ..... 81/124.2

* cited by examiner

*Primary Examiner* — Lee D Wilson
*Assistant Examiner* — Melanie Alexander
(74) *Attorney, Agent, or Firm* — Law Offices of Eugene M. Cummings, P.C.

(57) ABSTRACT

A ceiling panel suspension system includes a tapered anchor installing head driver for use in a ceiling anchor pole system for installing anchors and associated support wires from a ceiling or other support structure to be used to support a suspended ceiling. The tapered body of the head driver enables an installer to better visually align the anchor with a previously drilled pilot holes.

10 Claims, 5 Drawing Sheets

CEILING SUPPORT INSTALLATION SYSTEM

CROSS-REFERENCE TO RELATED APPLICATION

None.

BACKGROUND OF THE DISCLOSURE

I. Field of the Disclosure

The present disclosure relates generally to an improved ceiling support system, and more particularly, to a ceiling support installation system having an extension pole, a tapered lag driver head, a wire hanger, and a complimentarily dimensioned ceiling anchor which provides for the efficient installation of anchors and associated support wires for a suspended ceiling.

II. Description of the Prior Art

It is common for panel ceilings in office buildings, warehouses and the like to be suspended from an overhead support structure. Such panel ceilings typically comprise a frame network which is supported by hanger wires attached to anchors threaded into the support structure, and removable panels which are supported by the frame network. By removing the ceiling panels, access can be gained to electrical wiring, plumbing, and ventilation ducts and the like installed above the ceiling.

Installation of the hanger wires used to suspend the frame network is often accomplished by the use of a wire installation head mounted on the end of an extension pole. The hanger wire is typically first threaded through a hole in the head of a ceiling anchor or similar fastener to be attached to the overhead support structure, and twisted back around itself for secure attachment to the anchor. In some installations, the anchor is bolted to the overhead support structure; in most installations, however, the anchor is a screw-type anchor which is screwed into the overhead support structure.

As a result of the distance between ground level and the overhead support structure, as well as the number of wires required to suspend a ceiling, it is inconvenient for an installer to carry the necessary equipment up and down a ladder and to move the ladder from location to location. While scissor lifts have been used to decrease the up and down time, they have proven to be bulky, inconvenient and even dangerous. Accordingly, pole tools have been developed which permit the installer to secure an anchor to an overhead support structure and install a wire to the anchor while remaining on the ground.

Typically, such pole tools include a lag driver head affixed to the end of the pole. The driver head is adapted to hold anchors or similar fasteners for subsequent attachment to the ceiling. A bore through the pole and an aperture through the lag driver head are provided so that hanger wires or threaded rods can be passed through the pole and driver head for connection to the anchor. A commonly used pole system is disclosed in U.S. Pat. No. 6,786,116 (Dockery), which is incorporated herein by reference.

The system disclosed by Dockery includes a telescoping pole and an anchor driving and wire twisting head. While this system does allow for an installer to secure anchors from the ground, depending on the height of the ceiling, accurate placement is often difficult. Additionally, suspending ceilings from a concrete support structure will necessitate that pilot holes be drilled before anchor placement. With use of a traditional pole system such as disclosed by Dockery, it has proven to be difficult to accurately locate these pilot holes from the ground in order to screw in the anchors.

Accordingly, it is a general object of the present disclosure to provide a panel ceiling support system which enables a panel ceiling to be efficiently suspended from an overhead support structure.

It is a more specific object of the present disclosure to provide a panel ceiling anchor pole system that allows an installer to visually align an anchor to a pilot hole in an overhead support structure.

It is yet another object of the present disclosure to provide a panel ceiling installation system that allows an installer to efficiently and safely install ceiling anchors and associated support wires.

These and other objects, features and advantages of the disclosure will be clearly understood through a consideration of the following detailed description.

SUMMARY OF THE DISCLOSURE

According to one embodiment of the present disclosure, there is provided an anchor driver for use in conjunction with a pole tool for securing anchors in an overhead support structure. The driver includes a beveled body portion that defines a taper from its mounting portion to its head portion. The head portion includes two perpendicular channels for receiving the anchor and its associated support wire, respectively. A retaining ring is disposed about the head of the driver wherein the ring and the taper define a field of view for the installer to visually confirm accurate placement of the anchor.

There is also provided a pole tool for securing anchors in an overhead support structure. The tool includes an extendable body having a base adapted to operatively couple with a power drill and a connector adapted to couple with an anchor driver. The driver includes a beveled body portion that defines a taper from a pole mounting portion to a head portion wherein the head portion includes perpendicular first and second channels for receiving an anchor and a support wire, respectively. A retaining ring is disposed about the head of the driver wherein the ring and the taper define a field of view for the installer to visually confirm accurate placement of the anchor.

There is further provided a system for securing support anchors and associated support wires from an overhead support structure for supporting a suspended framework. The system includes an anchor and associated support wire and a pole tool. The tool includes an extendable body having a base adapted to operatively couple with a powered drill and a connector adapted to couple with an anchor driver. The driver includes a beveled body portion that defines a taper from a pole mounting portion to a head portion wherein the head portion includes perpendicular first and second channels for receiving an anchor and a support wire respectively. A retaining ring is disposed about the head of the driver wherein the ring and the taper define a field of view for the installer to visually confirm accurate placement of the anchor.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PRIOR ART

Figure 1:
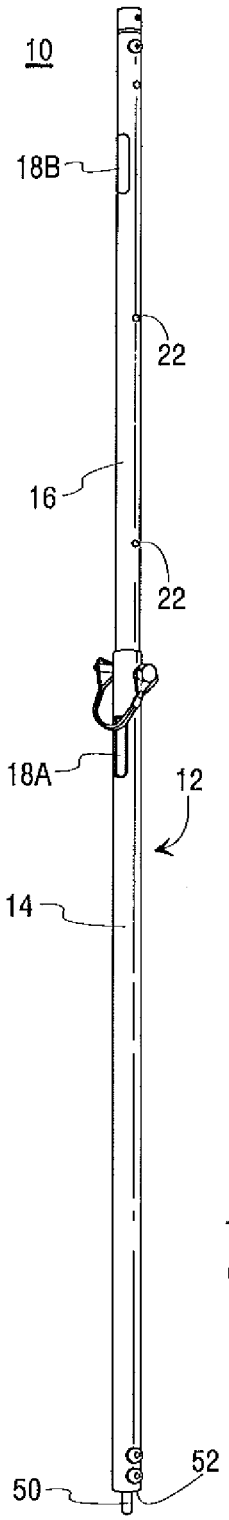
Fig. 1 (Prior Art)
FIG. 1 is a perspective view of a prior art anchor pole apparatus with body sections extended.
Figure 2:
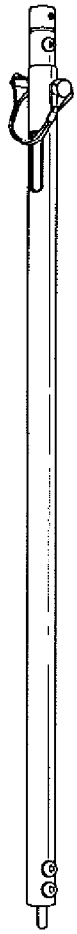
Fig. 2 (Prior Art)
FIG. 2 is a perspective view of the prior art anchor pole apparatus of FIG. 1 with body sections collapsed.
Figure 3:
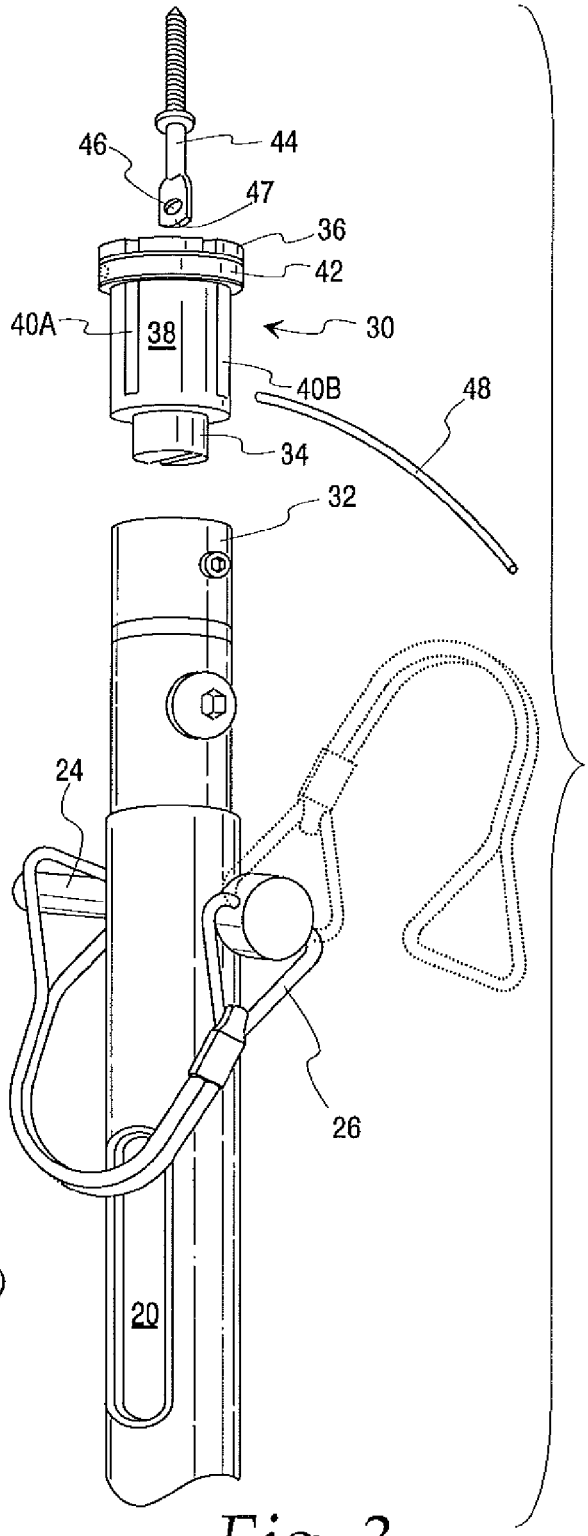
Fig. 3 (Prior Art)
FIG. 3 is an enlarged perspective view of a prior art anchor driver head used with the apparatus of FIG. 1.

Referring to FIGS. 1-3, there is shown a conventional pole apparatus 10 including a body 12 having, for example, at least a first 14 and a second 16 telescoping body member. The body is typically of tubular shape and cross-section and is made of steel. It will be appreciated that this pole apparatus can be of other shapes (i.e. a square or triangular shaped body) and that other materials (i.e. aluminum or alloys) can be utilized in its construction.

Apertures 18A and 18B are defined in the side of each body section 14, 16 to permit access into the interior 20 (FIG. 3) of the body 12 wherein support wires may be stored. As shown in FIG. 2, when the telescoping sections 14, 16 of the body 12 are in a non-telescoped or collapsed orientation, the respective apertures 18*a* and 18*b* of the body sections 14 and 16 are in radial alignment with one another.

A plurality of opposing bores 22 are disposed at predetermined lengths along the body 12. The bores 22 are engaged by a pin 24 (FIG. 3) such that the body sections 14, 16 are secured in either a telescoped or collapsed position depending on the needs of the installer. A clasp 26 may be disposed on the pin 24 such that the pin 24 is removably retained within the bore 22.

Referring to FIG. 3, a conventional anchor driver head 30 is shown in removable engagement with a connector portion 32 on the body 12 of the pole apparatus 10. The driver head 30 includes a mounting portion 34, for securing the driver 30 to the body via connector portion 32, and a head portion 36, for use in receiving fasteners or anchors. The head portion 36 of the driver 30 has a cylindrical body portion 38 and has a pair of axial channels 40*a*, 40*b* extending substantially the entire length of the cylinder, and further includes retainer ring 42 disposed proximate the head portion 36 of the cylinder.

During installation, the telescoping body members are first adjusted to the proper length. An anchor 44 is inserted into the head portion 36 of the driver through one of the channels 40A, 40B such that the eye 46 of the anchor can receive a section of a support wire 48 passing therethrough. Once the wire is received by a channel and the eye of the anchor, the pole system is raised against the support structure. The anchor can then be installed by rotating the pole manually or with the aid of a power drill coupled to the arm 50 (FIG. 1) protruding from the base 52 of the pole. Once the anchor is securely fastened, the pole is lowered slightly and rotated again to twist the wire 48 about the eye 46.

Figure 4A:
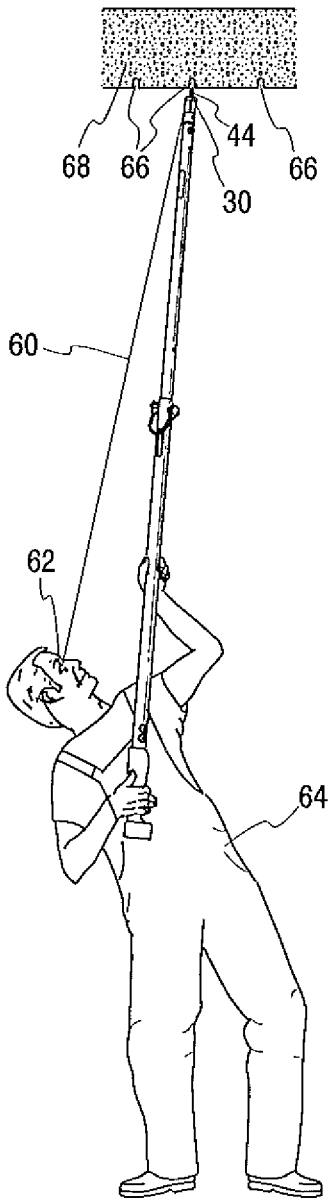
FIG. 4*a* is a side view of the anchor pole apparatus of FIG. 3 showing the line-of-sight of an installer.
Figure 4B:
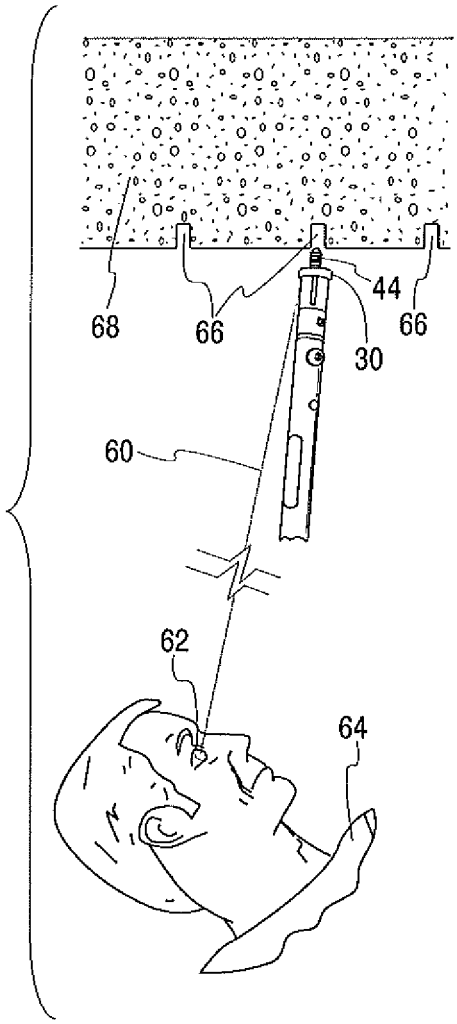
FIG. 4*b* is an enlarged view of the anchor driver head portion of FIG. 4*a* showing the line-of-sight of the installer.

In the event that the support structure is made of concrete and therefore requires pilot holes to receive the anchor, the installer often has difficulty aligning the anchor with the hole. In particular, FIGS. 4*a* and 4*b* show the line of sight 60 between the eyes 62 of an installer 64 and a pilot hole 66 (shown enlarged for clarity purposes) in the concrete support structure 68 being obstructed by the cylindrical shape of the driver head 30.

DESCRIPTION OF THE PREFERRED EMBODIMENTS

Figure 5:
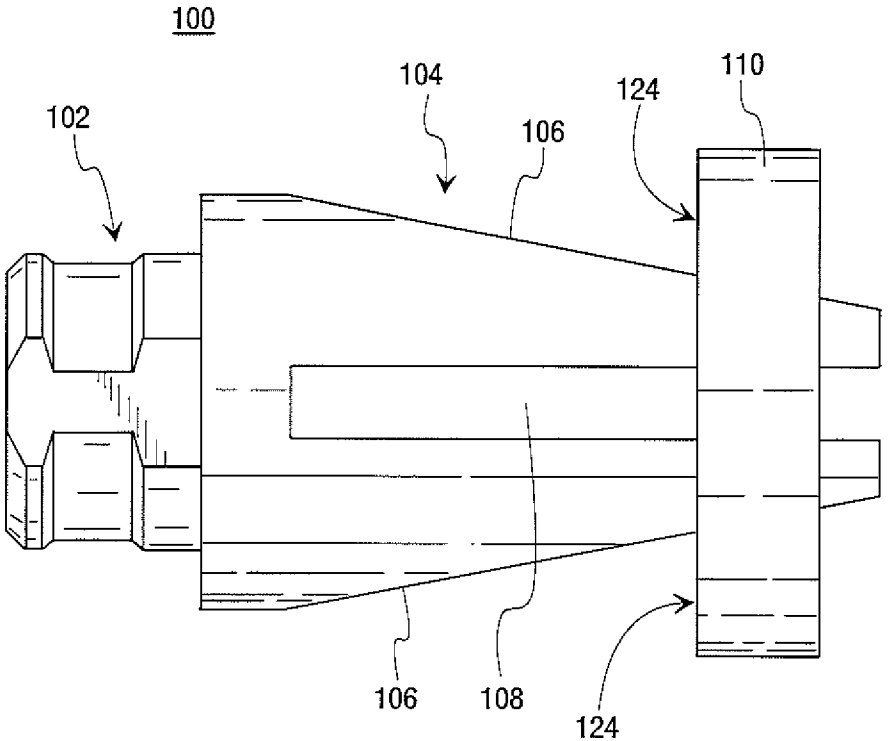
FIG. 5 is an enlarged side view of the driver head constructed in accordance with one aspect of the present disclosure.

One or more embodiments constructed in accordance with the disclosure will now be described with the aid of FIGS. 5-8*c*. FIG. 5 is a side view of the tapered anchor driver or anchor head or driver head 100. As shown, driver head 100 includes a mounting portion 102 for securing the driver to connector portion 32 (see FIG. 3), and a head portion 104 for receiving fasteners or anchors. Head portion 104 is not cylindrical, but is rather inclined, and accordingly is beveled to form a tapered body portion 106 and has a first channel or an axial channel 108 extending along a portion of the distal end of body 106. Preferably, and as shown in the Figures, opposing sides of cylindrical head portion are beveled and accordingly tapered on opposing sides, although it will be appreciated that a single bevel may be utilized. As such, the distal upper portion of head 104 resembles a truncated cone having opposing flat sides. Preferably, axial channel 108 extends substantially the entire length of the head, as shown in FIG. 5. A retainer ring or retaining ring 110 is disposed over the anchor receiving end of the driver head. Retainer ring is dimensioned to engage the non-tapered portion of the cylindrical head portion 104 and there so engaged to provide a gap or space 124 between the inner diameter of ring 110 and the outer diameter of the tapered portion of head 104.

Figure 6:
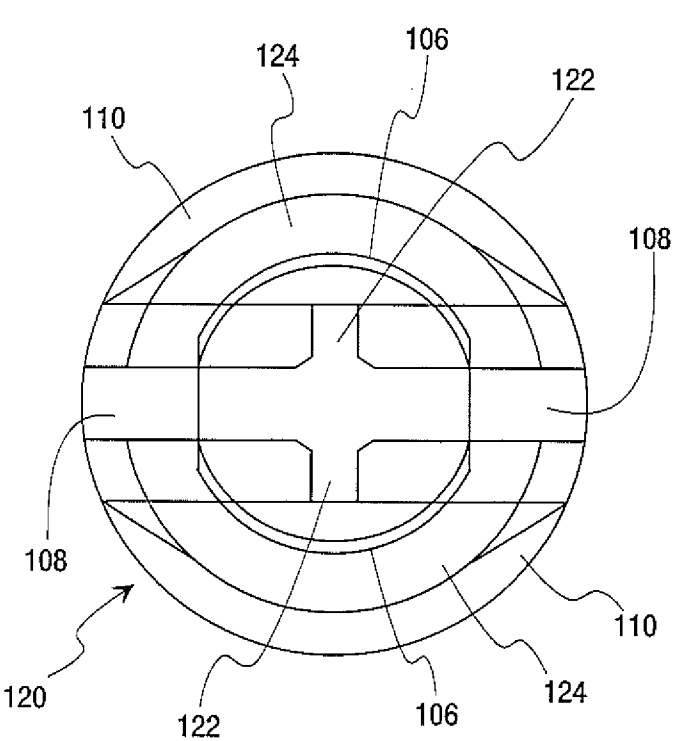
FIG. 6 is an end plan view of the driver head of FIG. 5.
Figure 7B:
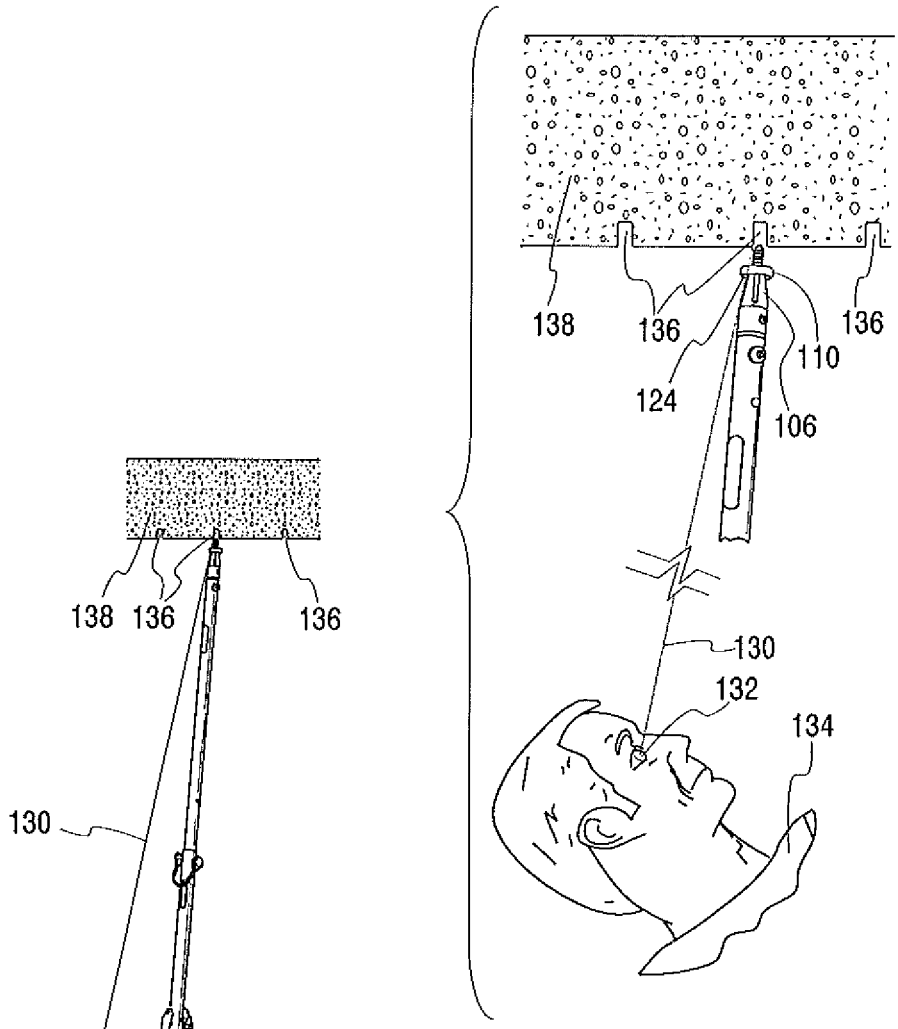
FIG. 7*b* is an enlarged view of the anchor pole apparatus of FIG. 7*a* showing the line-of-sight of an installer using the apparatus.
Figure 7A:
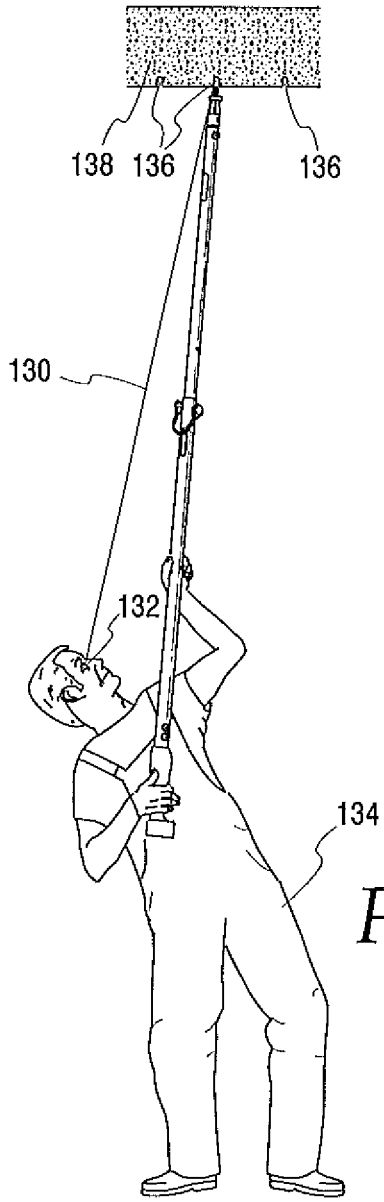
FIG. 7*a* is a side view showing the line of sight of an installer using an anchor pole system incorporating an anchor driving head constructed in accordance with one aspect of the disclosure.

Referring now to FIG. 6, the face 120 of the driver head is described as it relates to its interaction with the support anchor and hanger wire. In particular, the anchor is placed within a second channel or an anchor receiving channel 122 such that the eye of the anchor is in axial alignment with the main head portion channel 108. The anchor receiving channel and the wire receiving channel are preferably in a perpendicular arrangement relative to the face of the driver. The support wire is then passed through the channel 108 and the eye of the anchor. As shown in FIGS. 7*a* and 7*b*, the tapered shape of the driver body 106 enables an installer view the anchor through the space 124 between the tapered surface and the retaining ring 110. In particular, the space between the truncated portion of the driver body and the retaining ring defines a field of view for the installer to visually confirm accurate anchor placement.

Once the anchor and hanger wire are installed within the driver head 100, the installer can accurately place the anchor in the support structure. In particular, as shown in FIGS. 7*a* and 7*b*, the aforementioned tapered body of the driver allows for the visual confirmation of correct anchor to pilot hole alignment. Specifically, the line of sight 130 between the eyes 132 of the installer 134 and the pilot hole 136 (shown enlarged for clarity purposes) in the concrete support structure 138 is unobstructed. More specifically, the installer 134 is capable of viewing the anchor entering the pilot hole 136 through the space 124 between the tapered body portion 106 of driver head 100 and retainer ring 110.

Figure 8A:
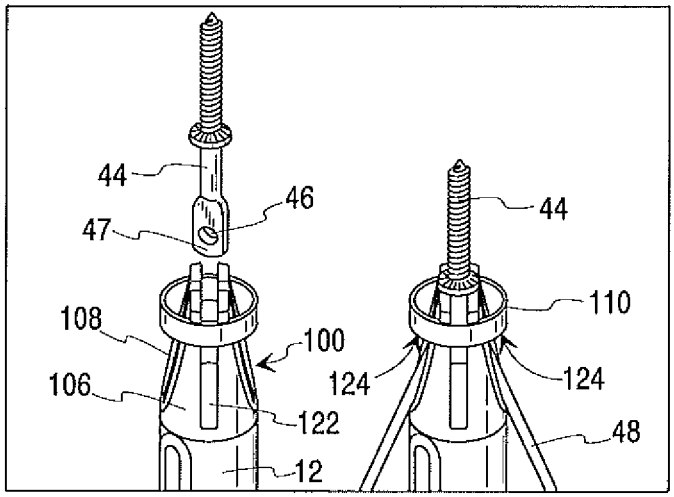
FIG. 8*a* is a top perspective view of the anchor driver head of FIGS. 5-7*b* showing the loading of an anchor into the driver head.
Figure 8B:
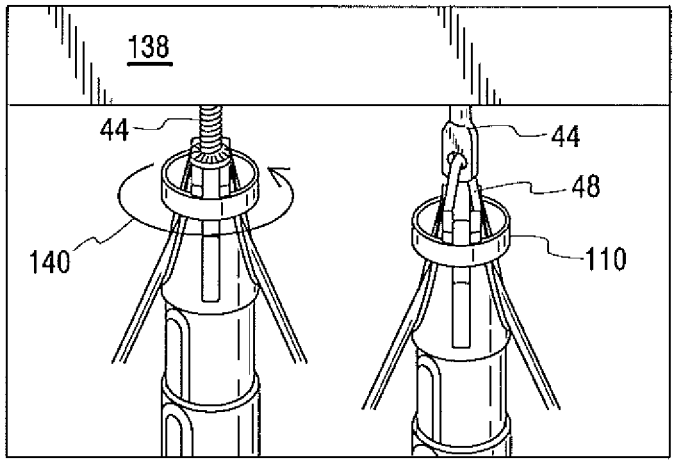
FIG. 8*b* is a top perspective view of the anchor driver head of FIG. 8*a* showing the installation of a support wire.
Figure 8C:
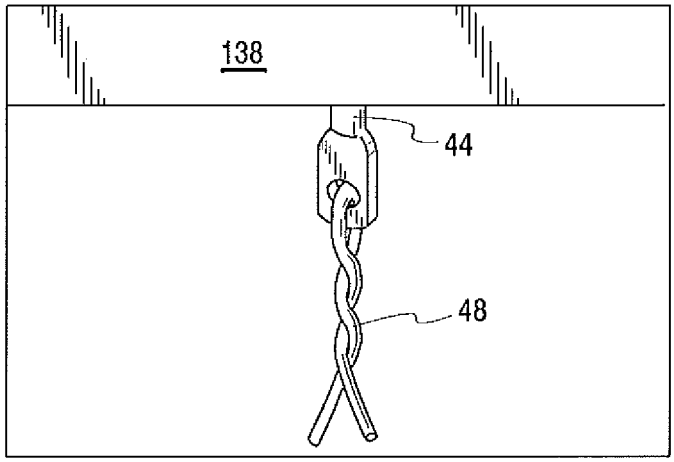
FIG. 8*c* is a perspective view of the installed anchor and support wire of FIG. 8*b*.

Referring now to FIGS. 8*a*-8*c*, the anchor and wire support installation is more particularly described as it relates to the tapered body of the anchor driver head 100. FIG. 8*a* illustrates the anchor 44 being inserted into the head portion of the driver and nesting in the anchor receiving channel 122. Preferably, the tab-like head portion 47 of the anchor is dimensioned in width and thickness to securely but freely slide into channel 122 without providing excess play which could make installation more difficult. Support wire 48 is the fed into the main head portion channel 108, thru the eye of the anchor, and down toward the body of the pole. Once both the anchor and hanger wire are installed, the pole system is ready to be used. As previously described, the tapered body portion of the driver head allows the installer to view the anchor and pilot hole through the space 124 between the tapered body 106 and the retaining ring 110. Once aligned, the anchor 44 is screwed into the ceiling 138 by rotating 140 the pole either manually or through the use of a power drill as previously described. When the anchor is fully seated, the pole is lowered slightly such that the wire 48 is held against the retainer ring 110 (see FIG. 8*b*). The pole is then rotated again to twist the wire about itself (see FIG. 8*c*). Following installation of all anchors 44 and wires 48, the suspended panel ceiling can be completed.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the disclosure if its broader aspects, and, therefore, the aim in the appended claims is to cover all such changes and modifications as fall within the true spirit and scope of the disclosure.

What is claimed is:

1. An anchor driver for use in conjunction with a pole tool for securing anchors in an overhead support structure, said driver comprising:

a mounting portion on a first end of said driver for securing the driver to a pole;

a head portion on a second end of said driver for receiving an anchor and an associated support wire;

a body portion tapered generally from said first end to said second end, said body including a first channel for receiving a support wire, said first channel extending from said head portion towards said mounting portion;

said head portion having a second channel for receiving an anchor, said second channel being perpendicular to said first channel;

a retaining ring having an outside diameter and an inside diameter, said ring disposed about said head portion wherein said inside diameter of said ring and said taper define a space therebetween; and wherein said tapered body portion is truncated and further defined by a bevel on opposing sides and defines two spaces between said ring and said taper.

2. The driver as defined in claim 1 wherein said second channel is dimensioned to securely fit a head of an anchor.

3. A pole tool for securing anchors in an overhead support structure, said tool comprising:

an adjustably extendable body having a base adapted to operatively couple with a powered drill, and having a connector adapted to couple with an anchor driver;

said driver having a body portion tapered generally from a pole mounting portion on a first end to a head portion on a second end wherein said head portion includes perpendicular first and second channels, said tapered body portion extending from said channels to said head portion for receiving an anchor and a support wire respectively; and a retaining ring having an outside diameter and an inside diameter, said ring disposed about said head portion wherein said inside diameter of said ring and said tapered second end define a space therebetween.

4. The tool as defined in claim 3 wherein said tool body having multiple telescoping sections whereby each telescoping section having one or more bores disposed therein for engagement with a cooperating pin.

5. The tool as defined in claim 3 wherein said tapered body portion of said driver is truncated and further defined by a bevel on opposing sides and defines two spaces between said ring and said taper.

6. The driver as defined in claim 3 wherein said first channel is dimensioned to securely fit a head of an anchor.

7. A system for securing support anchors and associated support wires from an overhead support structure for supporting a suspended framework, said system comprising:

a support wire;

an anchor having a head portion and further having an eye for receiving said support wire;

a pole tool having an adjustable body, said body of said tool having a base adapted to operatively couple with a powered drill, and having a connector adapted to couple with an anchor driver; and said driver having a body portion tapered generally from a pole mounting portion o11 a first end to a head portion on a second end wherein said head portion includes perpendicular first and second channels, said tapered body portion extending from said channels to said head portion for receiving an anchor and a support wire respectively; and a retaining ring having an outside diameter and an inside diameter, said ring disposed about said head portion wherein said inside diameter of said ring and said tapered second end define a space therebetween.

8. The system as defined by claim 7 wherein said tool body having multiple telescoping sections whereby each telescoping section having one or more bores disposed therein for engagement with a cooperating pin.

9. The system as defined by claim 7 wherein said tapered body portion of said driver is truncated and further defined by a bevel on opposing sides and defines two spaces between said ring and said taper.

10. The system as defined by claim 7 wherein said first channel is dimensioned to securely fit a head of an anchor.

* * * * *